United States Patent [19]

Finsterwalder et al.

[11] Patent Number: 4,615,203

[45] Date of Patent: Oct. 7, 1986

[54] COINING PRESS

[75] Inventors: Kurt Finsterwalder, Goeppingen; Rainer Güthle, Ebersbach, both of Fed. Rep. of Germany

[73] Assignee: L. Schuler GmbH, Fed. Rep. of Germany

[21] Appl. No.: 696,712

[22] Filed: Jan. 31, 1985

[30] Foreign Application Priority Data

Feb. 9, 1984 [EP] European Pat. Off. ..... 84101317.0

[51] Int. Cl.[4] ..... B21J 13/14

[52] U.S. Cl. ..... 72/345; 72/427

[58] Field of Search ..... 72/344, 345, 450, 451, 72/427; 10/11 E; 83/82, 135

[56] References Cited

U.S. PATENT DOCUMENTS 3,122,033 2/1964 Riemenschneider et al. ..... 72/427

FOREIGN PATENT DOCUMENTS 2336474 2/1975 Fed. Rep. of Germany ..... 72/4

53627 6/1910 Switzerland ..... 72/344

1027066 7/1983 U.S.S.R. ..... 72/344

*Primary Examiner*—Lowell A. Larson

*Attorney, Agent, or Firm*—Craig and Burns

[57] ABSTRACT

A one-armed ejection lever of a coining press is adapted to be controlled in one end section directly by the coining ram by way of a connecting rod and in the other end section by an operating piston-cylinder unit. The center portion of the ejection lever is placed by way of a pressure bolt against the projecting end of an ejection rod. The abutment pressure is produced by the operating piston-cylinder unit whereby the ejection coining die is able to yield by way of the ejection rod, for example, in case two pieces to be coined are in the coining tool in order to avoid damages. For multiple coining, it is additionally possible to act upon the operating piston cylinder unit in the opposite direction and to effect therewith an intentional lifting-off of the pressure bolt from the ejection rod.

14 Claims, 4 Drawing Figures

PIECE TO BE COINED IS PLACED IN FRONT OF COINING STATION
ROTATION OF DIAL PLATE
STOP PERIOD
INSERTION OF PIECE TO BE COINED
FORWARD STROKE OF SLIDE
ACCELERATION
DECELERATION
COINING
ACCELERATION
DECELERATION
BACKWARD STROKE
EJECTION OF COIN
III

COINING PRESS

The present invention relates to a coining press with a coining ram drive consisting of a triangular lever driven from a crankshaft by way of a center bearing, which is pivotally connected by means of a rear pivot bearing at a guide member and by way of the guide member on the frame and by means of a forward pivot bearing by way of a connecting rod with the coining ram, and with a drive of the ejection coining die derived from the ram drive by way of a connecting drive for producing an ejection movement which takes place essentially at the same time as the movement of the ram from its forward dead-center point to its rear dead-center point.

The present invention starts from a coining press of the type described in the European Patent Application, Publication No. 0101590, filed in the name of the assignee of the instant application. In further development of this prior art press, it is the aim of the present invention to protect the ejection coining die and with the additional use of an ejection rod acting on the ejection coining die, also the ejection rod and the coining tool. Damages may occur, for example, when a coining blank or unfinished piece is not correctly placed into the coining ring or the finished coin piece is not guided completely satisfactorily during ejection out of the area of the coining tool so that the finished piece finds itself together with the newly fed unfinished piece between the coining bottom die and the coining top die during the following coining stroke.

Therebeyond, it is necessary for burnish or polish coining to leave the piece to be coined in the coining matrix during several coining strokes. It is appropriate therefor to interrupt the operability of the ejection installation for subsequent strokes.

It is the object of the present invention to cause the means for avoiding damages in the ejection system and at the coining tool and the means for the controlled interruption of the ejection activity, respectively, operability, to engage at a point of pivotal connection of the ejection lever and essentially by means which become effective.

The underlying problems are solved according to the present invention in that the connecting drive consists of a connecting rod pivotally connected directly at the coining ram and of a one-armed ejection lever which is pivotally connected with one end at the end of the connecting rod opposite the pivotal connection thereof at the coining ram and within an area of its length at the ejection coining die and in that the second end of the ejection lever is attached to the movable part of an operating piston-cylinder unit, otherwise fixed at the frame, which is pressure prestressed in the sense of a pressure abutment at the ejection coining die, possibly by way of an ejection rod.

By the double utilization of an operating piston cylinder unit, a compact assembly to be easily installed and adjusted, will result in an advantageous manner whose adjustability is controlled and whose function can be readily monitored. The present invention is the sequence of a chronological further development of the coining press of the type described above. However, existing coining presses can also be refitted to the system of this invention and such a system can also be taken over directly during the new development of coining presses which are in principle of different construction, such as, for example, upright or standing coining presses.

The transmitting means for the ram movement to the ejection lever are limited in accordance with the present invention to few means so that an excessive tolerance accumulation is avoided.

According to another feature of the present invention, a simple, reliable sensing of the ejection lever is possible prior to the occurrence of the damage.

The DE-OS No. 27 42 041 and the DE-OS No. 28 45 337 describe in part some individual features of the present invention. However, the means disclosed in these two prior publications serve different tasks and together do not act in the sense of the present invention on the point of pivotal connection of the ejection lever.

The first-mentioned prior publication discloses a transmitting lever displaced by the drive of a coining ram, which acts on one end of a two-armed ejection lever. The ejection lever is placed with its second end against an ejection rod and is pivotally connected in its center area of its lever length by way of an eccentric drive in the sense of an interruption of the ejection activity (stroke omission control).

The second-mentioned prior publication discloses an ejection system with an ejection extension adapted to be swung-in in the extension of the ejection rod by way of a piston cylinder unit.

These and other objects, features and advantages of the present invention will become more apparent from the following description when taken in connection with the accompanying drawing which shows, for purposes of illustration only, one embodiment in accordance with the present invention, and wherein.

Figure 1:
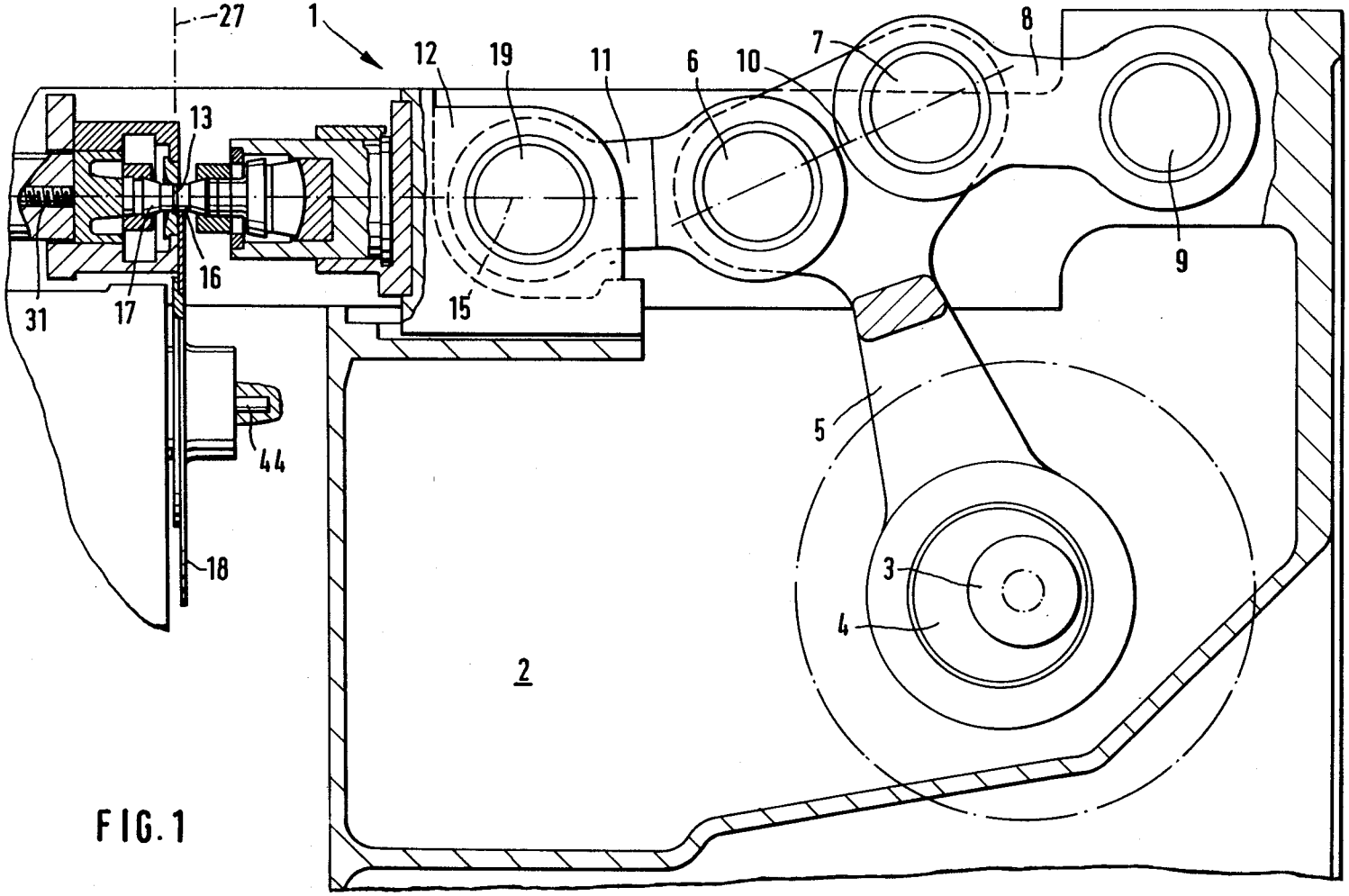
FIG. 1 is a partial view of a coining press, on a reduced scale, with a ram drive in accordance with the present invention, with some parts thereof shown in cross section.

Referring now to the drawing wherein like reference numerals are used throughout the various views to designate like parts, and more particularly to FIG. 1, a motor-driven crankshaft 3 is rotatably supported in the frame 2 of a coining press generally designated by reference numeral 1 for the drive of the center bearing 4 of a connecting rod 5 which is constructed in the manner of a triangular lever. A guide member 8 pivotally connected at 9 at the frame 2, is pivotally connected to the rear pivot bearing 7 of the triangular lever 5. The forward pivot bearing 6 is pivotally connected at the ram 12 in the point of rotation 19 by way of a connecting rod 11. The ram 12 is longitudinally displaceably supported in the frame 2 in the pressure direction, which lies in the die center line 15, and carries the coining or starting die 16 in its end portion opposite the point of rotation 19. The coining die 16 cooperates with the coining tool and, in particular, with the ejection coining or stamping die 17 when a piece 13 to be coined is oriented in the coining tool. The piece 13 to be coined may be fed into the coining tool, for example, by way of a feed plate 18 and may be guided out of this area by means of the feed plate 18 after the coining operation. The feed plate 18 is rotatably supported at 14 and is adjustable by way of a stepping circuit arrangement of any known type. The stepping drive, however, may also take place from the press drive itself. The feed plate 18 can be pivoted out of the coining area for changing the tool. The means for feeding the unfinished piece to be coined into the feed plate 18, the means for the stepwise movement and the means for the removal, respectively, the ejection out of the feed plate 18 are not illustrated in detail herein because they may be constructed in any conventional manner. Reference number 27 indicates the position of the piece 13 to be coined and the coining surfaces of the coining die 16 and of the ejection coining die 17. The latter cooperates with the ejection rod 31 (FIGS. 1 and 4) which is actuatable by way of a connecting drive, to be more fully described hereinafter, in the direction of an ejection movement guided along the die center line 15. Such a small gap for the accomodation of the piece 13 to be coined is provided between the coining die 16 and the ejection coining die 17 that the piece 13 to be coined is guided between the dies and by the dies essentially also after the coining operation. It is necessary therefor that the ram 12 and together with the latter the coining die 16 comes to a standstill within the area of the rear dead-center point $T_h$. The drive for the ram movement need not be disconnected thereby.

Figures 2, 3:
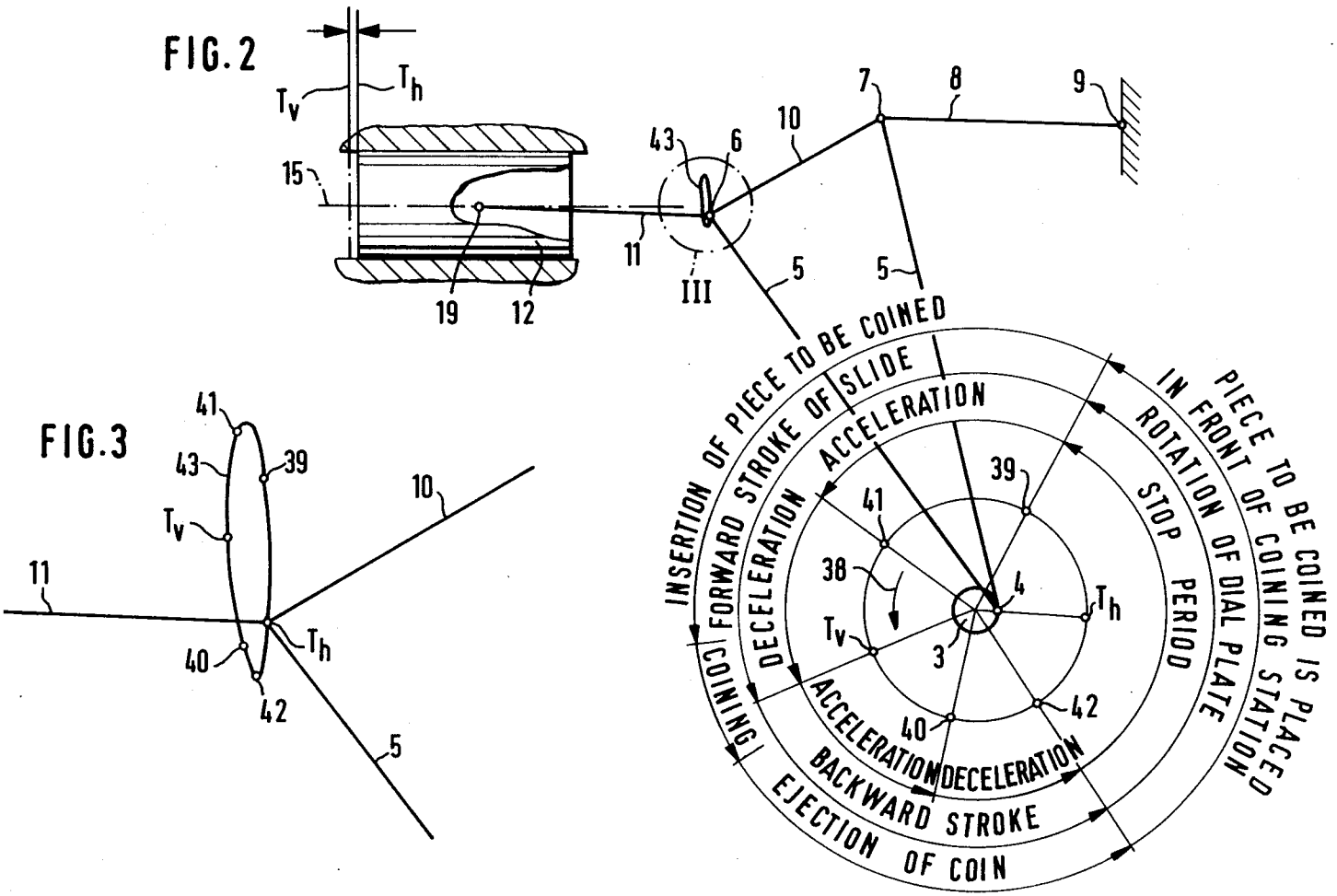
FIG. 2 is a schematic view illustrating the movement phases of the triangular lever system for the movement of the ram in accordance with the present invention.
FIG. 3 is a schematic enlarged view of the pivot movement of the forward pivot bearing, illustrated within the dash-and-dot circle III in FIG. 2.

A possibility therefor is illustrated in FIGS. 2 and 3. These figures illustrate in particular the phases of the finishing of the piece to be coined as a function of the rotary movement of the center bearing 4. The pivot bearing 9 on the side of the frame is arranged on the side opposite the crankshaft 3 in relation to the die center line 15. The guide member 8 together with the connected rear pivot bearing 7 is movable about the pivot bearing 9 along a circular arc with a radius corresponding to the guide member length. The distance from the center of the rear pivot bearing 7 to the center of the center bearing 4 is larger than the possible maximum distance from the center of the center bearing 4 to the die center line 15, measured as distance between the center of the center bearing 4 and the center of the rear pivot bearing 7. The distance from the center of the forward pivot bearing 6 to the center of the rear pivot bearing 7 as well as the distance from the center of the forward pivot bearing 6 to the center of the center bearing 4 are so designed and selected in each case that the center of the forward pivot bearing 6 lies on the side relative to the die center line 15 which is to be coordinated to the pivot bearing 9 on the frame side, always when the center bearing 4 assumes a position that corresponds to the forward dead-center point $T_v$ of the ram 12. In a position of the center bearing 4, which corresponds to the rear dead-center point $T_h$ of the ram 12, the center of the forward pivot bearing 6 lies on the side of the die center line 15 which is to be coordinated to the crankshaft 3. As a result thereof and as a result of the design of the lengths of the guide member 8, rocker 10, triangular lever 5 and position of the pivotal and engaging points 4, 6, 7, a pivot track 43 will result for the forward pivot bearing 6 which in the right curve portion, starting approximately from the radii illustrated at the top and bottom, forms at least nearly a circularly shaped curve portion which extends on both sides of the die center line 15. The rear dead-center point $T_h$ for the ram 12 lies within this curve portion so that the ram 12 does not change its position during the period of time of the traversal of the circularly shaped curved portion by the forward pivot bearing 6, whereby sufficient time is created for the change of the piece to be coined, the removal and insertion by the transport mechanism, i.e., the feed plate 18. The reference character $T_h$ in the right curve portion of the curve 43 designates the beginning of the dead-center point position of the ram 12 while the crankshaft 3, the center bearing 4 and the triangular lever 5 continue to move. With the rotation of the crankshaft 3 in the direction of the arrow 38, the change of the piece to be coined takes place after reaching the rear dead-center point. The taking along of the piece to be coined into the coining tool by the coining die 16 takes place at approximately the point 39, i.e., with the beginning of the acceleration of the ram 12. The acceleration phase is terminated approximately at the point 41; up to reaching the forward dead-center point $T_v$, the ram 12 is being braked or decelerated in the left curve portion at 41 as a consequence of the movement of the forward pivot bearing 6. The finished coined piece, for example, a coin or medal, is fed to the feed plate 18 after the ram 12 has passed through the forward dead-center point. The taking over of the coin into the feed disk 18 takes place thereby within a period of time of a strongly decelerating movement of the ram 12 up to approximately the indicated point 42. The forward pivot bearing 6 which is pivotally connected to the ram 12 by way of the connecting rod 11, is thus adapted to be driven over the endless or closed pivot track 43 while taking along the ram 12, and the ejection coining die 17 is adapted to be taken along at least for the range of the return movement of the ram by way of the connecting drive in the sense of an ejection movement so that also for the time after the coining, the finished coined part is guided on all sides by the coining die 16 and the ejection coining die 17 and between the same up to the transfer to the feed plate 18 possibly with inclusion of a slight clearance.

Figure 4:
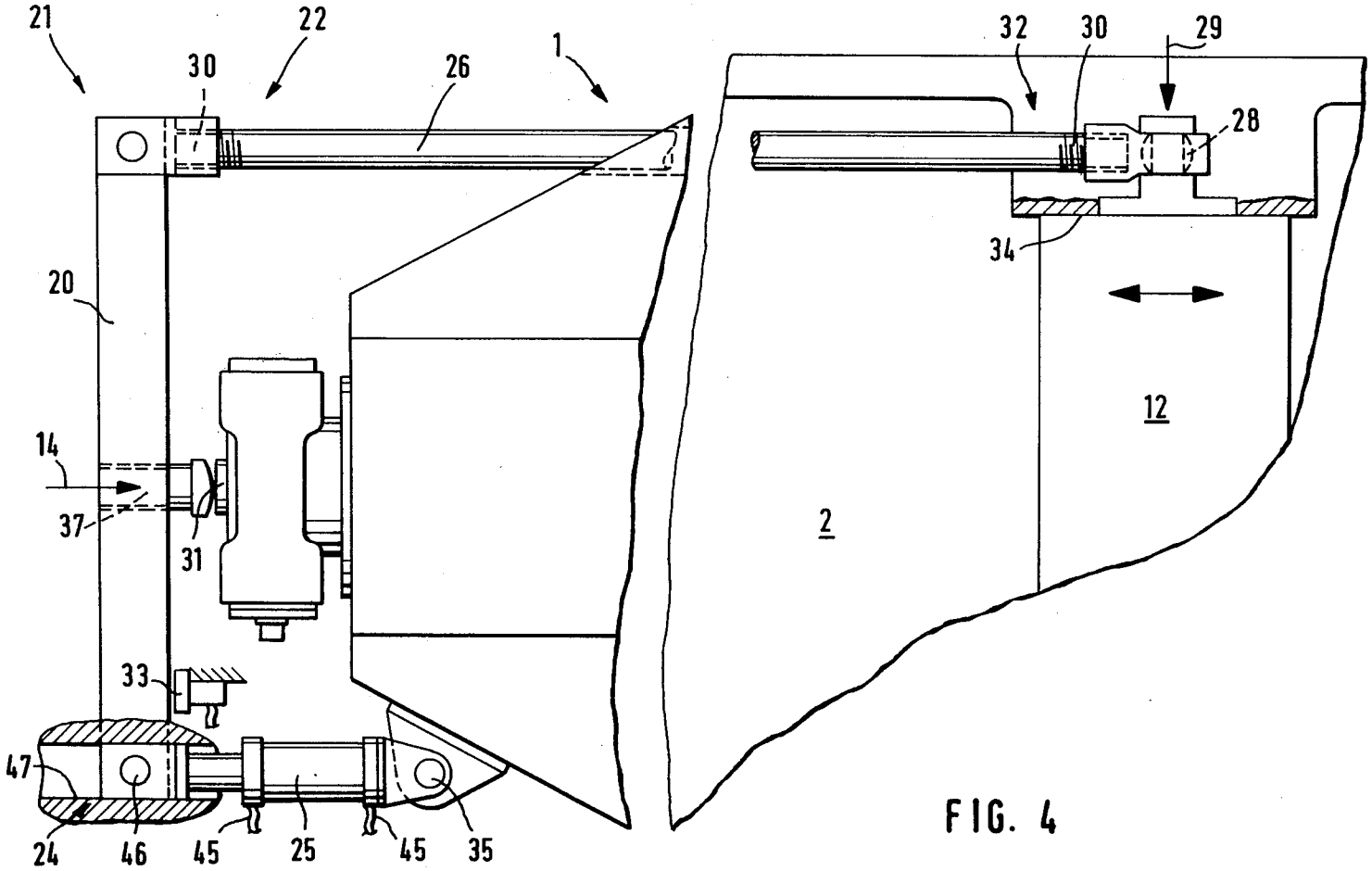
FIG. 4 is the connecting system for the ejection coining die according to the present invention, also shown on a reduced scale.

FIG. 4 illustrates the ram 12 which is displaceably supported in the frame 2 of the coining press 1 within slide bearings 34. The ram 12 includes a pivot point 29, in which a pressure or connecting rod 26 is rotatably supported by way of a threaded extension 30 and by way of a spherical (universal) bearing attached to the same. The connecting rod 26 is connected at the end 22 thereof opposite the point of pivotal connection at 29, to one end 21 of an ejection lever 20 by way also of a threaded extension 30 and a spherical (universal) bearing (not shown). The threaded extensions 30 serve for the length adaptation of the connecting rod 26 while the spherical bearings 28 serve for the angular positional compensation of the connecting rod 26 during the movements thereof. The ejection lever 20 is also pivotally connected with its end 24 opposite the first point of pivotal connection 21, to the piston or to the cylinder of an operating piston-cylinder unit 25 which can be mounted in a fixed point of pivotal connection 35 or fixedly at the frame 2. An adjusting bolt 37 is inserted in a center portion of the ejection lever 20, which acts on the projecting end of the ejection rod 31. The operating piston-cylinder unit 25 is acted upon by way of pressure connections 45, for example, with a pressure fluid in such a manner that for the normal, undisturbed ejection operation a fixed point 46 is formed for the ejection lever 20. On the other hand, the pressure magnitude is to be adjusted to such a value that the ejection lever 20 can deflect in the point 46 in case that, for example, two pieces to be coined are present between the coining tool and the pressure bolt 37 is movable in the direction opposite the direction of arrow 14. The deflection of the ejection lever 20 in such a case is detectable by a presence sensor 33 and can lead to the disconnection of the drive of the coining press. The operating piston cylinder unit 25 is to be guided at the fixedly arranged frame at 47 for a deflection movement of the ejection lever 20.

The operating piston cylinder unit 25 is further charged with the task, controlled by the pressure lines 45, to lift the pressure bolt 37 off the end of the ejection rod 31, respectively, off the ejection coining die 17 in order to interrupt the ejection activity for a multiple stroke, for example, for am aftercoining or polish (burnish) coining. It is necessary for that purpose to stop the feed plate 18 (FIG. 1) or to fill only each second or third filling place in the feed plate 18. The control must take place in a conventional manner by way of the press control. Such press control means which are known as such in the art and form no part of the present invention, can be realized by simple means and are therefore not described and shown in detail herein.

While we have shown and described only one embodiment in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are encompassed by the scope of the appended claims.

We claim:

1. A coining press comprising a coining ram means, drive means for the coining ram means including a triangular lever means driven from a crankshaft by way of a center bearing, the triangular lever means being operatively connected with a guide member by way of a rear pivot bearing and the guide member being pivotally connected at a relatively fixed press part, the triangular lever being operatively connected by way of a forward pivot bearing and a connecting rod with the coining ram means, an ejection coining die means, drive means for the ejection coining die means derived from the ram drive means by way of a connecting means to produce an ejection movement which takes place essentially simultaneously with the movement of the ram means from the forward dead-center point to the rear dead-center point, the connecting means including a connecting rod pivotally connected at the ram means and a one-armed ejection lever, said ejection lever being pivotally connected at one end with the end of the last-mentioned connecting rod opposite the pivotal connection thereof at the ram means, a piston-cylinder unit connected to a relatively fixed press part and having a movable member, the other end of the ejection lever being pivotally connected to the movable member, means operatively connecting the ejection lever within the area of its length to the ejection coining die means, and the piston-cylinder unit being pressure prestressed in the sense of a pressure abutment of the ejection lever at the ejection coining die means.

2. A coining press according to claim 1, wherein the piston-cylinder unit is pressure prestressed in the sense of a pressure abutment at the ejection die means by way of an ejection rod.

3. A coining press according to claim 2, wherein the second-mentioned connecting rod is pivotally connected at the ram means and at the ejection lever by way of spherical bearing means and is adjustable in its length at its ends by way of threaded extensions.

4. A coining press according to claim 3, wherein a presence sensor means is secured at the relatively fixed press part within the area of the piston-cylinder unit in operative connection with the ejection lever.

5. A coining press according to claim 1, wherein the second-mentioned connecting rod is pivotally connected at the ram means and at the ejection lever by way of spherical bearing means and is adjustable in its length at its ends by way of threaded extensions.

6. A coining press according to claim 1, wherein a presence sensor means is secured at the relatively fixed press part within the area of the piston-cylinder unit in operative connection with the ejection lever.

7. A coining press according to claim 6, wherein the second-mentioned connecting rod is pivotally connected at the ram means and at the ejection lever by way of spherical bearing means and is adjustable in its length at its ends by way of threaded extensions.

8. A coining press comprising a coining ram means, drive means for the coining ram means including a triangular lever means driven from a crankshaft by way of a center bearing, the triangular lever means being operatively connected with a guide member by way of a rear pivot bearing and the guide member being pivotally connected at a relatively fixed press part, the triangular lever being operatively connected by way of a forward pivot bearing and a connecting rod with the coining ram means, an ejection coining die means, drive means for the ejection coining die means derived from the ram drive means by way of a connecting means to produce an ejection movement which takes place essentially simultaneously with the movement of the ram means from the forward dead-center point to the rear dead-center point, the connecting means including a connecting rod pivotally connected at the ram means and a one-armed ejection lever, said ejection lever being pivotally connected at one end with the end of the last-mentioned connecting rod opposite the pivotal connection thereof at the ram means, a piston-cylinder unit connected to a relatively-fixed press part and having a movable member, the other end of the ejection lever being pivotally connected to the movable member, means operatively connecting the ejection lever within the area of its length to the ejection coining die means and the piston-cylinder unit being pressure prestressed to normally allow the ejection lever to cause the operative connecting means to connect the lever to the ejecting die in response to movement of the ram die and also being operable to stop the ejection lever from actuating the ejection coining die means in response to movement of the ram die.

9. A coining press according to claim 8, wherein the piston-cylinder unit is pressure prestressed in the sense of a pressure abutment at the ejection die means by way of an ejection rod.

10. A coining press according to claim 9, wherein the second-mentioned connecting rod is pivotally connected at the ram means and at the ejection lever by way of spherical bearing means and is adjustable in its length at its ends by way of threaded extensions.

11. A coining press according to claim 10, wherein a presence sensor means is secured at the relatively fixed press part within the area of the piston-cylinder unit in operative connection with the ejection lever.

12. A coining press according to claim 8, wherein the second-mentioned connecting rod is pivotally connected at the ram means and at the ejection lever by way of spherical bearing means and is adjustable in its length at its ends by way of threaded extensions.

13. A coining press according to claim 8, wherein a presence sensor means is secured at the relatively fixed press part within the area of the piston-cylinder unit in operative connection with the ejection lever.

14. A coining press according to claim 13, wherein the second-mentioned connecting rod is pivotally connected at the ram means and at the ejection lever by way of spherical bearing means and is adjustable in its length at its ends by way of threaded extensions.

* * * * *